United States Patent [19]

Hache

[11] 4,172,681

[45] Oct. 30, 1979

[54] SHEET PILE GUIDE

[76] Inventor: Joseph R. R. Hache, P.O. Box 832, Vedder Crossing, B.C., Canada, V0X 1Z0

[21] Appl. No.: 884,320

[22] Filed: Mar. 7, 1978

[51] Int. Cl.[2] ..... E02D 13/04; E02D 5/16

[52] U.S. Cl. ..... 405/303; 405/232

[58] Field of Search ..... 61/63, 53.5, 58, 60, 61/61, 62

[56] References Cited

U.S. PATENT DOCUMENTS

| | | | |
|---|---|---|---|
| 2,583,928 | 1/1952 | Caudill | 61/63 |
| 2,833,119 | 5/1958 | Molloy | 61/63 |
| 4,028,901 | 6/1977 | Barber | 61/63 |

*Primary Examiner*—Jacob Shapiro

*Attorney, Agent, or Firm*—Thomas O. Maser

[57] ABSTRACT

A work holder used for guiding a workpiece moved from one position to another during placement of the same and particularly sheet piling. The holder has an elongate rigid arm with an abutment at one end thereof for bearing against a rigid structure and a friction reducing unit at the other end of the arm for bearing against the workpiece during movement of the same. Between the abutment and the friction reducing unit there is a device for applying pressure to the arm to press the friction reducing unit against the workpiece. The pressure applying device has a first unit adapted to be detachably anchored to the rigid structure and a second unit, variable in length, connecting the first unit to the arm.

5 Claims, 7 Drawing Figures

SHEET PILE GUIDE

BACKGROUND OF THE INVENTION

1. Field of the Invention

This invention relates to a work tool and, more particularly, to a holder for use in guiding a workpiece while the workpiece is moved. The tool is primarily intended to support and guide sheet piling during the critical setting blows and throughout the driving period and will be described hereinafter with reference to such use. It will be readily apparent, however, the tool may be used for other purposes and, although the use herein is described with reference to sheet piling, it is not intended the invention be limited to the same.

2. Description of the Prior Art

Current practice for driving piles (pipe, post and sheet) is to have the pile driving attachment supported by a crane and the hammer driven by an air compressor. The size, weight and length of piles vary so widely that contractors adapt a wide range of means to hold the pile in place while it is being driven into the ground. Prior to the present invention, construction contractors have used anything readily at hand which can, at the time, be adapted to support the piles while the initial air hammer blow sets the sheet. Light sheet piling may initially be held by workmen during the initial setting blows of the impact device and, on heavier plate piling, it may be machine placed and supported. In either event it is unguided during the driving period and as a result may be deflected or change direction so that it does not end up in final position adjacent the previously driven piles.

SUMMARY OF THE INVENTION

Accordingly, a principal object of the present invention is to provide a tool which will guide a pile during the critical setting blows and throughout the driving period. The tool may be used in a variety of applications and is particularly useful under water, since it is easily attached in position and, once in position, it holds pressure on the sheet until removed and need not be adjusted during use.

A further principal object of the present invention is to provide a tool that is easily fabricated, relatively inexpensive, easy to use and repairable providing a long life for may years' use.

Accordingly, there is provided in accordance with the present invention a work holder for use in guiding a workpiece moved from one position to another during placement of the same, comprising: (a) an elongate rigid arm member; (b) an abutment on said arm for bearing against a rigid structure; (c) a friction reducing unit on said arm for bearing against the workpiece during movement of the same relative to the arm at a position spaced from said abutment; and (d) means for applying pressure to said arm at a position between said abutment and friction reducing unit to press the latter against the workpiece, said pressure applying means comprising a first unit adapted to be detachably anchored to a rigid structure and a second unit selectively variable in length connecting said first unit to said arm at a position between said abutment and friction reducing unit.

BRIEF DESCRIPTION OF THE DRAWINGS

The invention is illustrated by way of example with reference to the accompanying drawings wherein.

DESCRIPTION OF THE PREFERRED EMBODIMENT

Figure 1:
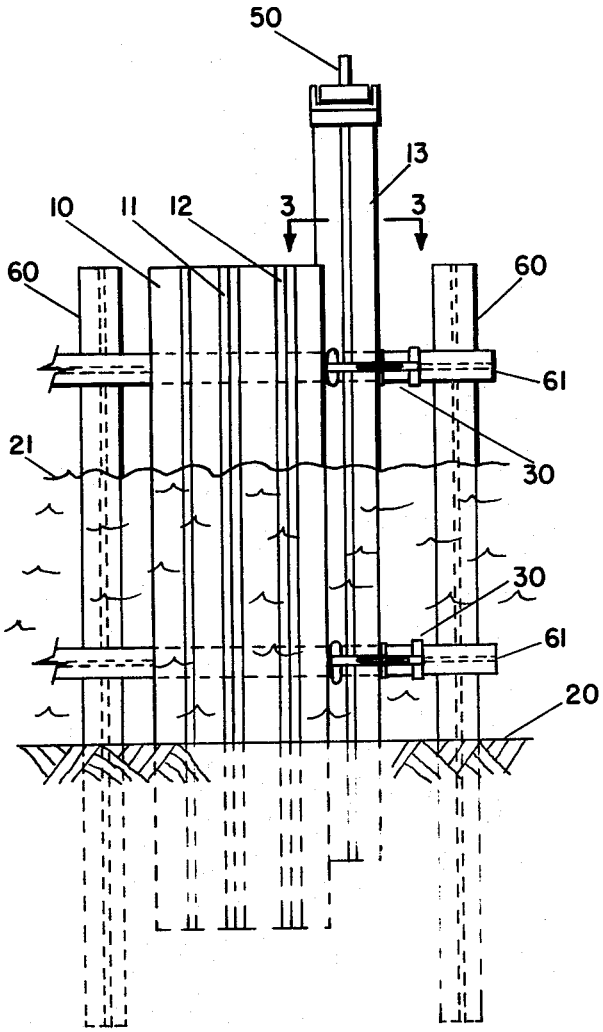
FIG. 1 is a front elevational view illustrating sheet piling driven into a river bottom and a further sheet pile to be placed in position and supported by two of the work guides constructed in accordance with the present invention.
Figure 3:
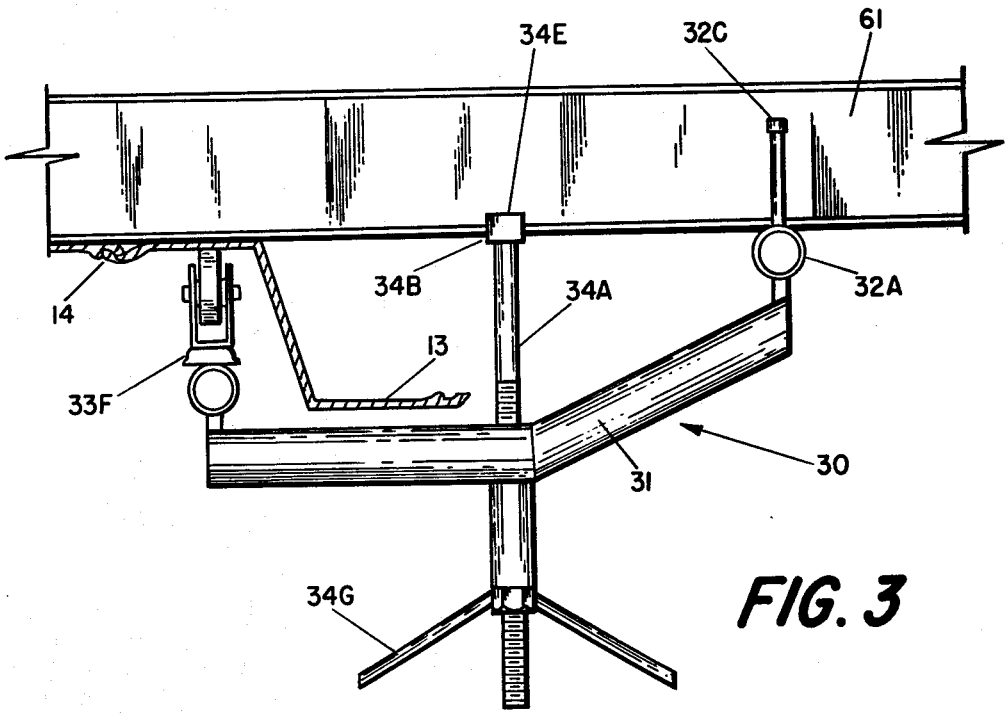
FIG. 3 is a sectional view, taken essentially along line 3—3 of FIG. 1, but on an enlarged scale.
Figure 4:
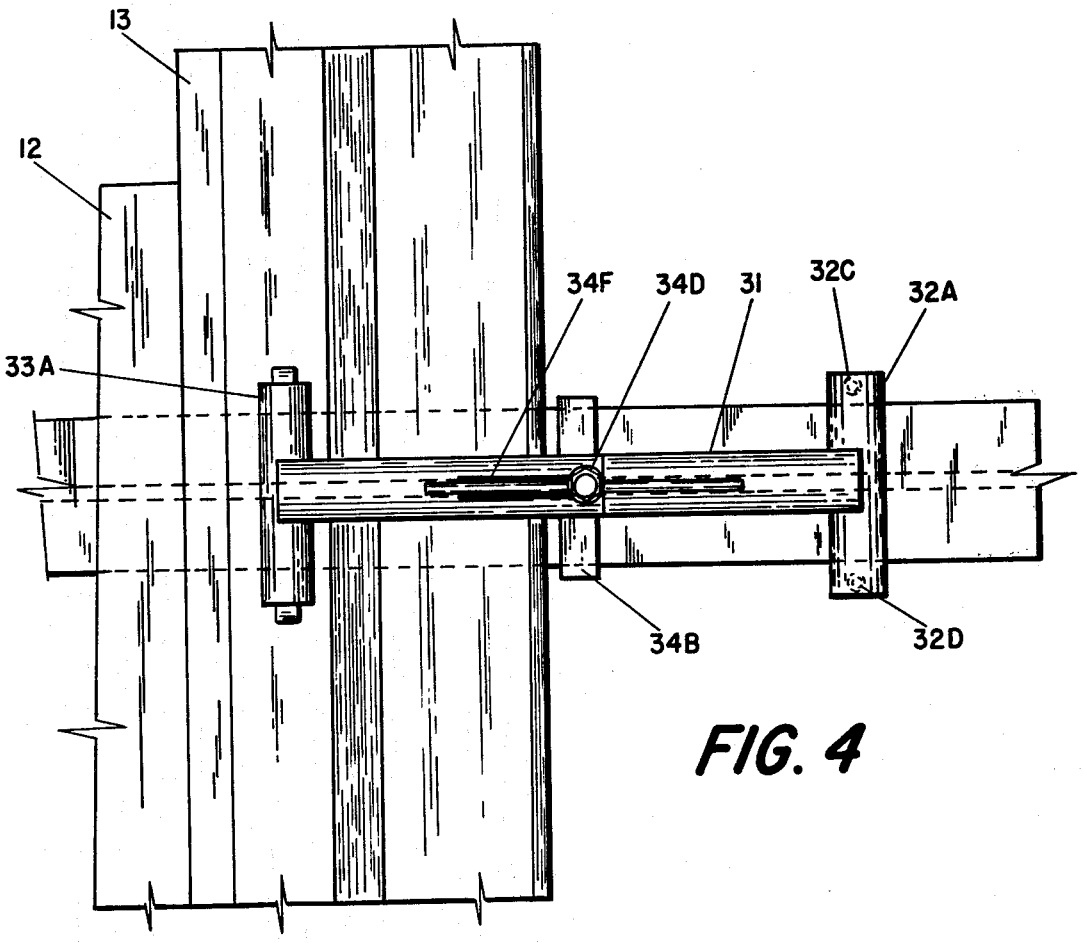
FIG. 4 is a front elevational view of FIG. 3.
Figure 5:
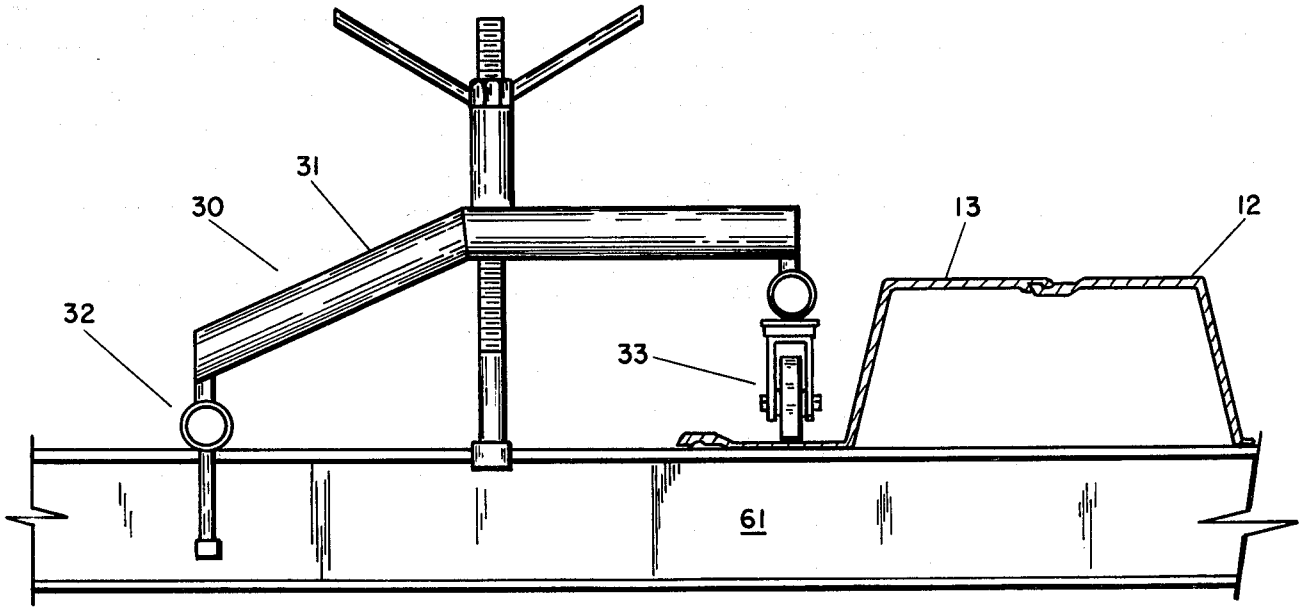
FIG. 5, appearing on the same sheet of drawings as FIG. 1, is similar to FIG. 3, but illustrating the guide in a position holding the next adjacent piling being connected to the last shown piling in FIG. 3.

Referring now in detail to the drawings, shown in FIG. 1 are three sheet type pile members 10, 11 and 12 which have previously been driven into their final position in a river bed 20 below the water surface 21. Adjacent pile member 12 there is a pile member 13 that is in the process of being driven into the river bed by a conventional impact device designated generally by the reference numeral 50. Pile member 13 is supported on a rigid frame structure by two work holders or tools 30 constructed in accordance with the present invention and which will be described in detail hereinafter. The pile members illustrated are deformed plate or sheet metal members having interlocking adjacent marginal edges designated generally by the reference numeral 14 (see FIG. 3) but, obviously, may be any well known sheet, plate, or column-like members.

Figure 2:
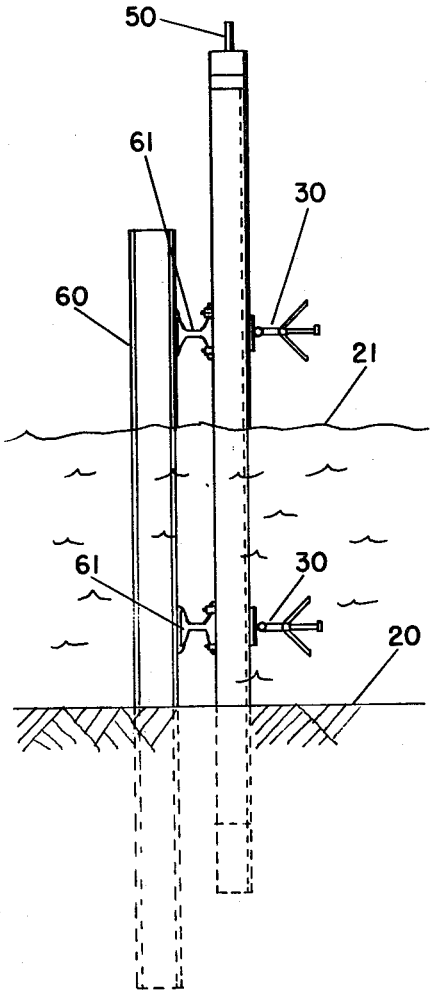
FIG. 2 is a left hand side elevational view of FIG. 1.

The rigid frame structure consists of vertical posts 60 (see FIG. 2) having horizontally disposed I-beams 61 attached thereto. The rigid supporting structure may be anchored in any convenient manner and, in FIG. 2, is illustrated with the posts 60 set in the river bed. Although the post and beams shown are wide flange or H-type members, they obviously may be structural members having other cross-sectional shapes. The tools are designed particularly for attachment to I-beams and, if other shapes of structural members are used, appropriate modification will be required for anchoring the tools thereto. The tools 30 press the pile being driven (in this case pile 13) against the flat faces of the two beams 61, positively guiding the pile while it is driven to final set in the river bed by the impact device.

Figure 6:
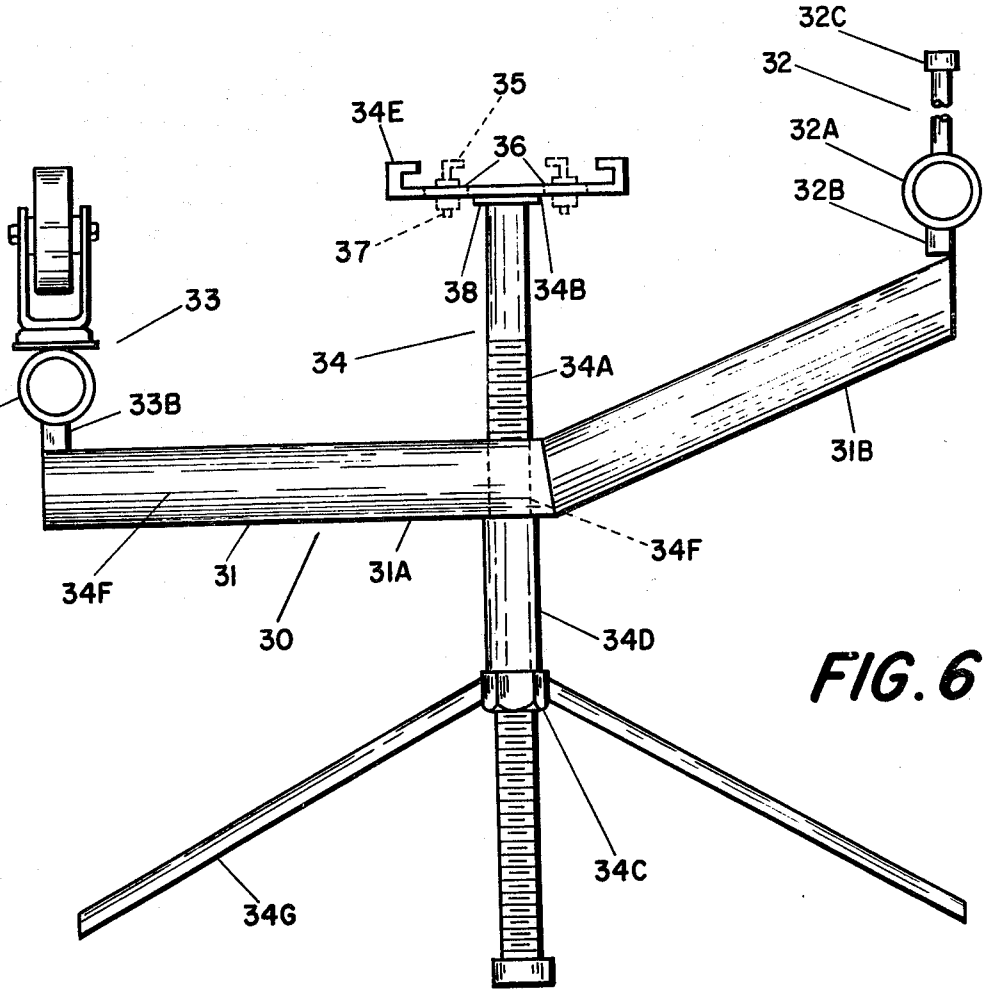
FIG. 6 is a front elevational view of a tool constructed in accordance with the present invention showing details of the same.
Figure 7:
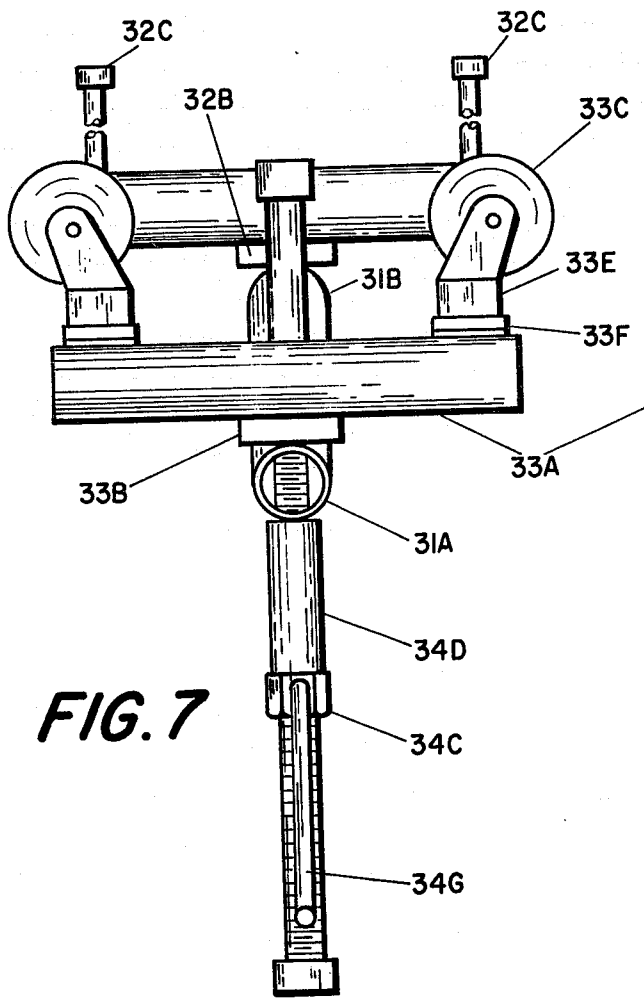
FIG. 7, appearing on the same sheet of drawings as FIG. 2, is a right hand side elevational view of the tool shown in FIG. 6.

Referring now particularly to FIGS. 6 and 7, the work holder or tool 30 consists essentially of a rigid arm 31 having mounted thereon an abutment 32 for bearing against beam 61, a friction reducing unit 33 for bearing against the pile member being driven into place, and a pressure applying unit 34 for forcing the friction reducing unit against the face of the pile member. Arm 31, although it may be of any configuration, is preferably a rigid steel tube having angularly related leg portions 31A and 31B. The abutment 32 consists of a tubular steel member 32A extending transversely to the length of the arm 31A and attached to the free outer end of leg member 31B, as by welding, by way of a spacer 32B. A pair of locating pins 32C are rigidly attached to and project outwardly from pipe member 32A on a side thereof opposite to that of the arm 31 and are spaced apart from one another to receive therebetween beam member 61. These locating pins, although being shown fixedly secured to pipe member 32A, may be adjustably attached thereto for varying the space therebetween to receive different sized beams. Friction reducing unit 33 is located at the end of the arm 31 opposite to that of the abutment 32 and includes a further steel pipe member 33A extending transversely of the arm 31 and rigidly attached thereto, as by welding or the like, by way of a spacer 33B. A pair of wheels designated 33C are attached to the pipe member 33A adjacent respective opposite ends thereof by respective ones of a pair of yoke members 33E. The yokes preferably are attached to the pipe member by a rotary coupling 33F having a pivot axis substantially perpendicular to the axis of rotation of the wheels associated therewith. These wheels (preferably steel to withstand high loads) are in rolling contact with one face of the pile being placed and press the opposite face of the pile against beams 61, the rolling pressure being variously adjustable by the pressure applying unit 34.

The pressure applying unit 34 is located on the arm 31 between the abutment 32 and the friction reducing unit 33 and, in the embodiment illustrated, comprises a threaded bolt 34A having a beam attaching member 34B fastened to one end thereof for clipping onto beam 61 and a wing type nut unit 34C threaded onto the bolt and bearing against a sleeve 34D which in turn bears against the arm 31 around an aperture therein through which the threaded bolt 34A passes. The aperture through the arm may be circular, positively locating the pressure applying unit in a selected position relative to the length of the arm 31 or, alternatively, a slot 34F (as illustrated), preferably approximately 6" long, permitting variously positioning the pressure applying unit at different locations longitudinally along the arm.

The beam attaching member 34B is effectively a "C" clip and two different embodiments are shown in FIG. 6. One embodiment is shown in solid line and the other in dotted line. The embodiment in solid line comprises a web fixedly secured to the bolt 34, as by welding or the like and having inwardly turned lugs, designated 34E, for clipping onto the flange of beam 61. The space between the lugs is preferably less than the width of the beam flange so as to avoid accidental disengagement therewith after attachment thereto. Attachment to the beam in such case is effected by first hooking one lug 34E to the beam flange and then shifting the unit laterally relative to the length of the beam sufficiently to allow the free end of the other lug to pass by the beam flange. Thereafter a slight rotation of the beam attaching member about an axis perpendicular to the face of web 34B places both of the lugs behind the beam flange for engaging the same. The space between the pair of lugs, however, can be greater than the width of the beam flange, in which case slightly more rotation of the beam attaching member will be required. The embodiment illustrated in dotted line consists of lugs 35 slidable in slots 36 in the web for movement toward and away from one another to variously adjust the spacing therebetween and lockable in different slide positions by locking means 37. The latter embodiment adapts the tool for use with beams which differ widely in size.

The nut 34C has arms 34G rigidly secured thereto, facilitating manually turning the nut to apply appropriate pressure on the friction reducing unit 33 to firmly press the pile against the beam. Alternatively, the nut portion may be non-rotatively associated with the arm 31, in which case bolt 34A is rotated by a wrench or arms attached thereto. In this instance, the threaded bolt is attached to web 34B by a rotary coupling 38.

As an alternative to the bolt and nut pressure applying unit 34 a rack, ratchet and pawl type device (similar to an automobile bumper jack) may be used. In this embodiment (not shown), a rack (replacing bolt 34) is attached at one end to web 34B by rotary coupling 38 and extends through slot 34F in arm 31. A ratchet and pawl is mounted on arm 31 and operated by a lever to move arm 31 longitudinally along the rack. The rack, ratchet and pawl has the advantage of being capable of providing both a coarse adjustment facilitating mounting the tool on the support structure and a fine adjustment providing appropriate mechanical advantage for pressing the friction reducing unit against the workpiece.

I claim:

1. A work holder for use in guiding a workpiece moved from one position to another during placement of the same, comprising:

(a) an elongate rigid arm member;

(b) an abutment on said arm for bearing against a rigid structure;

(c) a friction reducing unit on said arm for bearing against the workpiece during movement of the same relative to said arm at a position spaced from said abutment; and (d) means for applying pressure to said arm at a position between said abutment and friction reducing unit to press the latter against the workpiece, said pressure applying means comprising a first unit adapted to be detachably anchored to a rigid structure and a second unit selectively variable in length connecting said first unit to said arm at a position between said abutment and friction reducing unit.

2. A work holder as defined in claim 1 wherein each of said abutment said friction reducing units includes a rigid elongate member fixedly secured to said arm and disposed transversely to the longitudinal axis thereof.

3. A work holder as defined in claim 2 wherein said friction reducing unit includes a pair of rollers journalled for rotation on one of said transversely disposed elongate members and wherein said abutment includes a pair of locating pins spaced apart from one another on the other one of said transversely disposed elongate members.

4. A work holder as defined in claim 1 wherein said means for applying pressure to the arm comprises a threaded bolt having means at one end thereof for detachably connecting the same to the rigid supporting structure at a position between the friction reducing unit and the abutment, said threaded bolt passing through an aperture in the rigid arm and having a nut threaded on the portion projecting therethrough.

5. A work holder as defined in claim 3 wherein said aperture in the arm is an elongated slot thereby providing means to variously position the pressure applying means at different locations longitudinally of the arm between the abutment and friction reducing unit.

* * * * *